US005205438A

United States Patent [19]

Southard

[11] Patent Number: 5,205,438

[45] Date of Patent: Apr. 27, 1993

[54] SQUEEZE TUBE OPERATION AND ENABLING STRUCTURE

[76] Inventor: Albert A. Southard, R.R. #3, Box 47, Council Grove, Kans. 66846

[21] Appl. No.: 723,569

[22] Filed: Jul. 1, 1991

[51] Int. Cl.[5] ..... B65D 35/00

[52] U.S. Cl. ..... 222/1; 222/99

[58] Field of Search ..... 222/1, 95, 99, 100, 222/101, 103, 107, 206, 214

[56] References Cited

U.S. PATENT DOCUMENTS

| | | | |
|---|---|---|---|
| 2,672,258 | 3/1954 | Marberg | 222/100 |
| 2,862,647 | 12/1958 | Dietz | 222/99 |
| 3,463,359 | 8/1969 | Piggush | 222/103 |
| 3,628,696 | 12/1971 | Duiker | 222/99 |
| 4,452,823 | 6/1984 | Connolly et al. | 222/99 X |
| 4,807,782 | 2/1989 | Meinerding et al. | 222/1 |
| 5,014,879 | 5/1991 | Hill | 222/214 X |

FOREIGN PATENT DOCUMENTS

| | | | |
|---|---|---|---|
| 1548613 | 12/1968 | France | 222/103 |
| 559878 | 3/1957 | Italy | 222/99 |
| 572846 | 2/1976 | Switzerland | 222/99 |
| 0701423 | 2/1952 | United Kingdom | 222/99 |
| 1324161 | 7/1973 | United Kingdom | 222/99 |

*Primary Examiner*—Andres Kashnikow
*Assistant Examiner*—A. Pomrening
*Attorney, Agent, or Firm*—Robert E. Breidenthal

[57] ABSTRACT

A procedure for dispensing and exhausting the contents of a squeeze tube, wherein the exhausted extent of the tube is rolled or folded along one side of the tube and the resulting convolutions are retained against one side of the tube by rolling a resilient loop along the opposite side of the tube. A squeeze tube is provided with a resilient loop embracing one side of the tube at the end thereof remote from the dispensing opening enabling execution of the above procedure.

10 Claims, 2 Drawing Sheets

FIG. 1
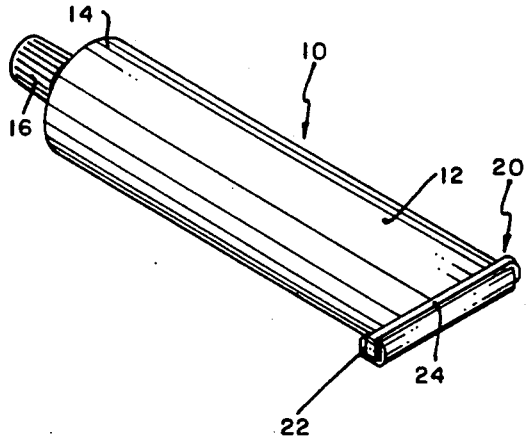
FIG. 2
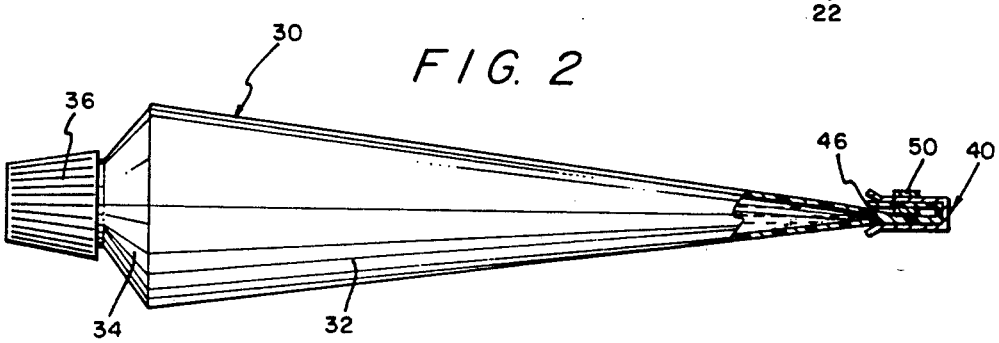
FIG. 5
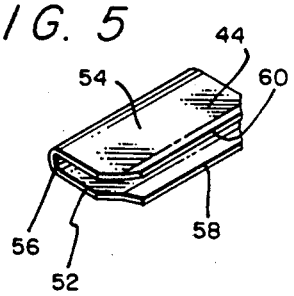
FIG. 3
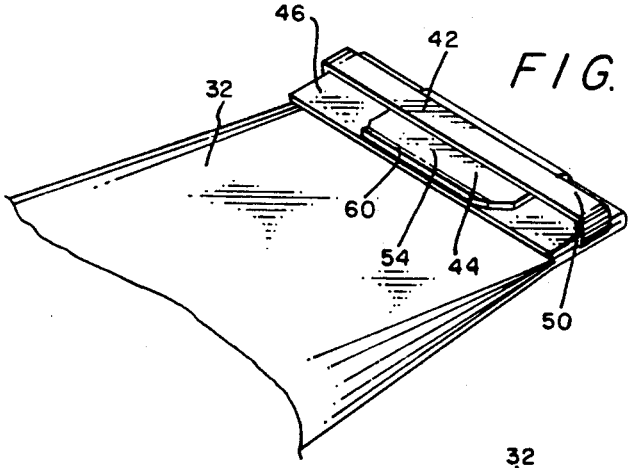
FIG. 6
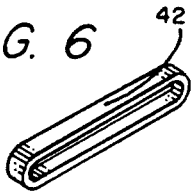
FIG. 7
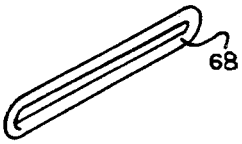
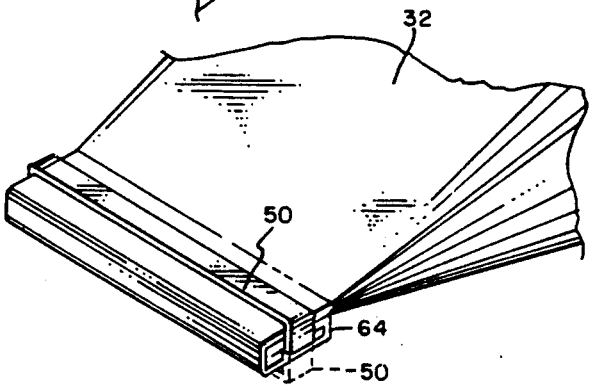
FIG. 4

SQUEEZE TUBE OPERATION AND ENABLING STRUCTURE

BACKGROUND OF THE INVENTION

1. Field of the invention

The present invention relates to new and useful improvements in squeeze tubes and for accessories therefor, and concerns elongated squeeze tubes of the type for containing and for controllably dispensing viscous or plastically flowable contents thereof through a normally closed dispensing opening at one end that can be selectively opened to allow the flow of a volume of tube contents corresponding to the amount that the tube is squeezed. More specifically, the invention is concerned with a procedure or method of and structure enabling the squeezing of a tube so that, in a progressive fashion, the tube is preferentially voided of its contents most remote from the opening with the voided extent of the tube being rolled and retained in a rolled condition at one side of the immediately adjacent, yet to be voided, portion of the tube.

2. Description of Related Art

Squeeze tubes have been widely known and used for many years, and have typically been largely thin walled structures made of malleable, ductile or plastic alloys of metals such as aluminum, lead, tin, etc., having little if any elasticity or resilience. Recently, however, squeeze tubes have been made of flexible synthetic resins or plastics.

Customary usage of metallic squeeze tubes entailed squeezing the end of the tube remote from the dispensing opening, and concurrently or thereafter rolling up the collapsed portion of the tube. Many users, much to the dispair of others, simply squeezed the tube and neglected to roll the tube despite appearances, and others had to content themselves with the hope that the slothful or careless user would recap the tube after use to prevent leakage or tube content contamination.

Quite often, users of the metallic tubes were provided with a finger-operated winding key to facilitate neat and uniform rolling that was often difficult to achieve.

With the advent of the transition from metallic to plastic for synthetic squeeze tubes, a new set of problems arose in connection with such tubes having considerable elasticity and a pronounced tendency for the tube wall to return to or approach its initial configuration when the tube was full.

While the elastic plastic tubes enjoy the advantage of presenting an external surface of smooth and rounded contours, and never having the appearance of a tin can that has been the object of boys playing stick hockey in the street, such tubes do not share an important advantage of metallic tubes, namely, the substantially total absence of voids within the tube.

Though a plastic tube may be initially free of voids, voids therein will occur on any restoration of initial tube configuration after having been partially squeezed. Such restoration not only makes the actual remainder of tube contents deceptive to visual inspection (a nearly empty plastic tube may appear full), but worse, air with its microscopic contaminants such as bacteria, spores, yeast, etc., can enter the tube and deleteriously affect tube contents.

Keys of various forms to facilitate plastic tube rolling have been proposed, but these ordinarily project laterally from the tube to a degree deemed objectionable by many, but worse, the elastic tubes tend to unroll the rolling that may have already been accomplished.

SUMMARY OF THE INVENTION

The paramount object of the present invention is to devise a procedure or method for expeditiously rolling squeeze tubes, elastic as well as inelastic, and for retaining the rolled portion of the tube in rolled condition.

Collaterally, it is a very important object of the invention to provide a squeeze tube or accessories therefor to enable practice of the procedure or method of the preceding paragraph.

An ancillary object is to provide a fully assembled squeeze tube suitable for use in accordance with the method aspects of the invention with such squeeze tube presenting no special packaging problems, that is, it can be packaged and shipped in the same container or package ordinarily employed for a conventional squeeze tube of the same content.

A closely related objective is to provide either the squeeze tube of the preceding paragraph in disassembled form or to make available to the public such squeeze tube accessories as to make it possible for the consumer to make appropriate modification of extant squeeze tubes. A desideratum is that the accessories be such as to be recoverable from an exhausted tube for application to a new tube.

Broadly the invention involves a method of forcibly urging and retaining the viscous contents of a capped squeeze tube dispenser toward the capped end thereof from its sealed end after partially dispensing tube contents and capping the tube, wherein a resilient and flexible loop is provided that can at least partially embrace one side of the tube adjacent the flattened and sealed end of the tube, said method comprising the steps of rolling the tube from its sealed end toward the capped end thereof to form convolutions thereof at the opposite side of the same, while moving the loop toward the capped end of the tube to prevent unrolling of the convolutions and to hold the latter against the opposite side of the tube.

Another broad aspect of the invention involves the provision in combination with a squeeze dispensing tube of the class including an elongated flexible and tubular body having a closable dispensing opening at one end and which is flattened and sealed at its other end, the improvement comprising a loop structure of a resilient and flexible material together with means for securing the loop structure to the sealed end of the tube in an arrangement such that the loop is generally normal to the longitudinal extent of the tube and embraces one side of the tube adjacent the sealed end of the tube.

BRIEF DESCRIPTION OF THE DRAWINGS

Other objects, features and advantages of the invention will become apparent during the ensuing description of a preferred embodiment thereof, such description being given in conjunction with the accompanying drawings illustrative thereof wherein:

FIG. 1 is an isometric view of a full squeeze tube of simple form that incorporates a retaining loop disposed in readiness to retain tube portions that are rolled as tube contents are extruded therefrom;

FIG. 2 is a side view, partially in section, of a modification of the structure shown in FIG. 1 wherein a spring clip serves to secure the retaining loop to the tube;

FIG. 3 is a fragmentary isometric view of the squeeze tube of FIG. 2;

FIG. 4 shows a step of moving the loop from the dashed line position (shown in full lines in FIGS. 2 and 3) to the full line position on the side of the tube opposite the roll or coil of tube material;

FIG. 5 is an isometric view of the spring clip;

FIG. 6 is an isometric view of the elastic retainer loop incorporated in FIGS. 2–4, such loop being continuous and substantially rectangular in section along its entire extent;

FIG. 7 is a modified form of the elastic loop, the same being substantially of elliptical transverse section;

DESCRIPTION OF THE PREFERRED EMBODIMENTS

Figure 8:
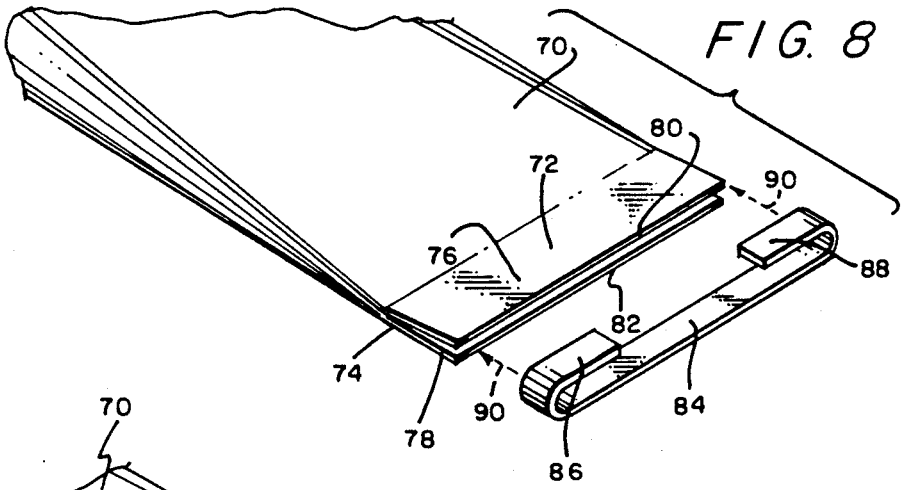
FIGS. 8–10 show sequential steps in the fabrication of yet another embodiment of the squeeze tube; and, FIGS. 11 and 12 show sequential steps in the fabrication of yet another form of squeeze tube, such steps to be followed by another step quite analogous to that depicted in FIG. 10.

Referring now to the drawings wherein like numerals designate like parts throughout the various views, attention is initially directed to the embodiment of the invention shown in FIG. 1, wherein the reference numeral 10 designates generally an elongated squeeze tube that is conventional except wherein it is expressly stated otherwise.

The tube 10 includes an elongated, thin-walled tubular portion 12 that is integral with a relatively thicker head portion 14.

The head portion 14 by reason of its thickness, is relatively stiff and terminates in an externally threaded and hollow boss constituting a dispensing opening (none of which is shown) that is normally and conventionally closed by an internally closure cap 16.

The tube 10 as thus far described is entirely conventional, and wide variations therein may be made and yet be appropriate to the instant invention, and this will become quite manifest to those conversant with the art as this disclosure proceeds.

The tube 10 departs from the conventional in that the end thereof remote from the cap 16 is specially provided with coil holder means designated generally at 20.

The means 20 comprises an end of the tubular body being flattened and sealed in a conventional manner with a portion of the sealed end of the tubular structure 12 being rolled upon itself to form a convolution or roll thereof designated at 22. Such convolution 22 is much in the nature of an early stage of customary tube usage by the consumer; however, the tube 10 is specially provided with a resilient coil retainer loop 24.

The exposed extent of the loop 24 is parallel to the sealed end of the tube 10 and is seated against the side of the tubular structure opposite the convolution 22. The loop 24 is secured to the tube 10 so as to project in opposite directions from the center of the convolution at the opposite ends of the exposed extent of the loop 24.

Most conveniently, the loop 24 can be comprised of a continuous ring of resilient material, such as rubber. With this loop form, the loop 24 is secured to the tube 10 by the simple expedient of the annular body constituting the loop 24 simply embracing the tubular body 12 through the center of the convolution 22 of the latter.

Alternatively, the loop can be constituted of a double-ended strip of resilient material with opposite end portions of such strip being attached to the opposite center portions of the convolution 22.

The exposed extent of the loop 24 can be uniformly of rectangular transverse section as shown. Such configuration is much preferred for a reason to be presently explained, but such is not essential and the transverse section can be made elliptical, or indeed the transverse section can vary in shape and size along its length. For example, the central part of the exposed extent of the loop 24 can be rectangular as shown and smoothly merge with elliptical sections adjacent the convolution 22.

The procedure for utilizing the structure of the tube 10 on expressing or dispensing a portion of the contents of the tube 10 (toothpaste, adhesive material, pipe joint component, bathtub calking, and the like) involves rolling the convolution 22 and the exposed loop 24 toward the dispensing end of the tube. Such rolling operations can be conducted concurrently, though preferably such rolling operations are preferably alternately executed. For example, the convolution 22 is rolled a fraction of a revolution and then the loop 24 is rolled to place the same in opposition to the convolution 24 as shown in FIG. 1. The rolling operations are preferably repetitiously and alternately performed until the remaining tube contents are compacted therein.

It is thought evident that the loop 24 bearing against the tube structure 12 opposite the convolution tends to keep the convolutions tight and to prevent unrolling thereof. The loop 24 has very little if any tendency to unroll, and manifestly such is all the more the case when the loop 24 had a rectangular transverse section as shown.

The fully assembled tube 10 can be marketed as shown with no change in the shape or size of packaging being imposed by reason of the provision of the coil holding means 20.

Attention is now directed to the embodiment shown in FIGS. 2–6, wherein a similar squeeze tube is provided having a different form of coil holding means. The reference numeral 30 designates generally a squeeze tube according to the invention. The tube includes an elongated and thin-walled plastic body 32 that has an integral head portion 34 at its dispensing end, with a closure cap 36 removably closing a dispensing opening, not shown.

The squeeze tube 30 includes a coil holder means 40. As with the tube 10 the end opening portion 46 of the tubular body 32 remote from the cap 36 is flattened and sealed. With a plastic body, such sealing can be by heat sealing or by suitable solvent or sealing agent as is customary. If a metallic material is selected for the body 32, conventional sealing techniques are employed such as by crimping, not shown.

The means 40 comprises a resilient annular loop 42 is secured to the body 32 by a spring clip 44 in an arrangement such that an end portion 46 of the body 32 extends through the loop 42 with such end portion 46 being retained in a folded back condition by the spring clip 44 with one side 50 of the loop 42 being exposed and its other side sandwiched between the body 32 and the end portion 46 folded thereover.

The loop 42 is a continuous resilient band of uniform rectangular transverse section, and may be of rubber or any other suitable elastomic material.

The spring clip 44 is clearly shown in FIG. 5 to be of a U-shape configuration with substantially parallel sides or legs 52 and 54 joined by an arcuate bite portion. To facilitate assembly of spring clip 44 on the tube body 32, the end margins of the legs 52 and 54 are flared from each other as shown at 58 and 60. It will be understood that such flaring serves to guide the clip 44 and make it easy to press the clip on to the folded end portion into the position shown in FIG. 2. The clip 44 is made of a resilient material, metal or preferably a synthetic resin, so as to serve as a clamp when the legs 52 and 54 are flexed apart as in FIG. 2.

The initial step in using the structure of FIG. 2 is to roll the loop 42 about the end of the tube 30. Then the clip held end of the structure is folded toward the cap 36 in the same direction as the folded portion 46 to form a convolution 64 (see FIG. 4. Thereafter, the loop 42 is rolled about the end of the structure from the dotted to the full line position shown thereof in FIG. 4.

The configuration of the means 40 as shown in full lines in FIG. 4 is quite analogous to the means 20 of FIG. 1 and the procedure of ensuing use is essentially identical in that the convolution 64 and the loop 42 are concurrently or alternately rolled toward the cap.

While the loop 42 of which the loop portion 50 is the exposed part is of uniform rectangular transverse section as shown, the loop 42 can take the form of the loop 68 shown in FIG. 7, such loop 68 being of elliptical section. While the illustrated loop 42 is much preferred, such configuration is not essential.

FIG. 8 illustrates a stage in the fabrication of the squeeze tube of FIG. 1 when the latter has a double-ended loop rather than a continuous loop.

The structure of FIG. 8 includes a tubular plastic body 70 that has been flattened at one end to define a flattened end portion 72. The opposite edges of the end portion 72 are longitudinally slitted at 74 and the upper and lower sides 76 and 78 of the body 70 are separated slightly at their free end edges as indicated at 80 and 82.

The numeral 84 designates a resilient double-ended band having interned end portions 86 and 88. The band 84 is moved in the direction indicated by the arrows 90 to position the ends 86 and 88 between the upper and lower sides 76 and 78 of the body 70. The sides 76 and 78 are then sealingly secured together with the band portions sandwiched therebetween. Should the materials of the body 70 and the band be suitable to heat sealing, the sealing can be so effected, or alternatively, a suitable adhesive and sealing agent is introduced between the upper and lower sides 76 and 78 before the latter are pressed together to engage the sandwiched ends 86 and 88 of the band 84.

Thereafter the flattened portion 72 is folded upwardly and the free or exposed loop portion of the band 84 rolled down about the end of the structure. The resulting assemblage constitutes a squeeze tube like that illustrated in FIG. 1, and the procedure of use is the same as previously given in relation to the tube 10.

Figure 9:
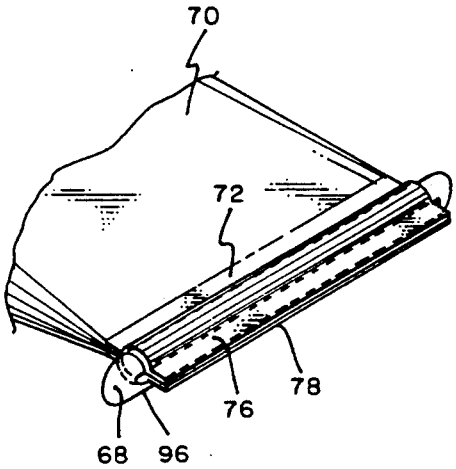

The technique of fabrication described above in connection with FIG. 8 does not require a band 84 of the configuration shown, and indeed the band can be continuous and of configurations such as shown in FIG. 6 or FIG. 7. FIG. 9 illustrates the result obtained on using the continuous band 68 in lieu of the double-ended band 84.

Figure 10:
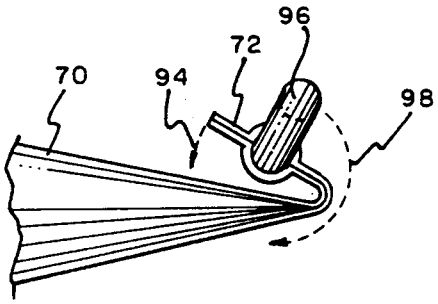

FIG. 10 shows treatment of the structure of FIG. 9 to ready the same for use. Such treatment involves folding the flattened portion 72 in the direction shown by the arrow 94 to seat against the body 72, after which the exposed portion 96 of the band 68 is rolled about the end of the structure as indicated by the arrow 98 to be disposed on the side of the body 70 opposite the portion 72. The resulting configuration is suited for use by alternately folding or rolling the structure inclusive of the flattened portion 72 and the exposed loop 96 toward the uncollapsed part of the body 70.

Figure 12:
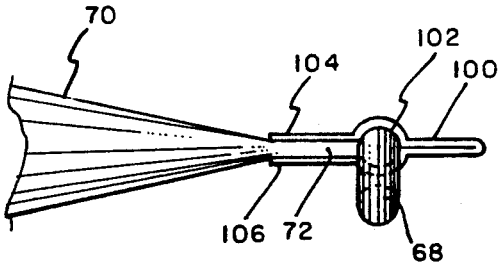
Figure 11:
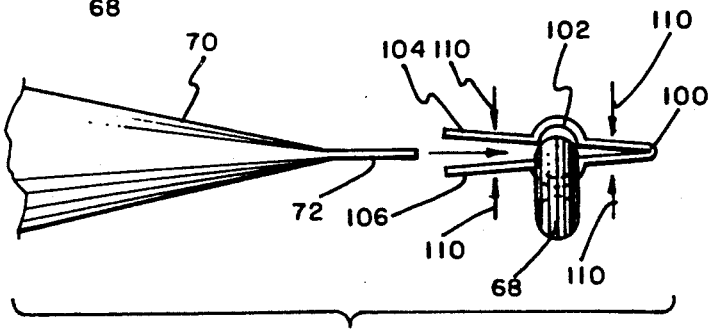

Attention is now directed to FIGS. 11 and 12, wherein another modification of the coil holder means is disclosed. As in previously described embodiments, the numeral 70 designates a portion of the elongated tubular body that is remote from the capped dispensing end (not shown) of a squeeze tube.

The end portion 72 of the body 70 is flattened and sealed. A retainer loop such as the band 68 is secured to the body 70 by a mounting clip 100. The mounting clip 100 is of a bifurcated configuration having opposed grooves or recesses 102 accommodating therein nearly one-half of the extent of a retaining band 68. Upper and lower bifurcations 104 and 106 are secured to the upper and lower sides of the flattened portion 72 of the body 70 received therebetween; such securance being effected in any suitable manner such as by thermal fusion or by use of an appropriate adhesive and pressure. When heat sealing is applied, such operation can also serve to concurrently seal the upper and lower extents of the flattened portion 72.

The structure of FIG. 12 can be manipulated in a manner analogous to that described in connection with FIG. 10 as will be evident.

FIG. 11 shows a step in the fabrication of the FIG. 12 structure. The resilient clip or mounting structure 100 initially requires spreading the bifurcations 104 and 106 apart and the seating of the loop 68 in the recesses 102. Alternatively, the loop 68 can be forced between the ends of the bifurcations and into the recess to obtain the configuration shown at the right hand side of FIG. 11.

The flattened portion 72 of the body 70 is now moved between the bifurcations to abut the loop 68. Force is now applied to the mounting clip or structure 100 in the directions indicated by the arrows 110, together with heat if fusion bonding is to be effected. Alternately, a suitable adhesive bonding agent can be applied to the surfaces to be joined prior to the application of bonding force.

Having now fully described the invention as to its use, structure and fabrication, attention is now directed to the appended claims in order to ascertain the actual scope of the invention.

I claim:

1. A method of forcibly urging and retaining the viscous contents of an elongated and flexible dispenser tube of the type having a capped end and a flattened and sealed end toward the capped end from its sealed end, after partially dispensing the contents of the dispenser tube and capping the tube said method comprising the step of securing an elongated flexible loop structure to the tube adjacent the sealed end thereof so that an extent of such structure is disposed along and embraces one side of the tube with such extent being normal to the length of the tube, said method further comprising the steps of flattening and rolling the tube from its flattened and sealed end toward the capped end thereof to form convolutions that are disposed on the side of the tube opposite said one side thereof, said rolling the loop structure extent along said one side of the tube toward the capped end of the tube to prevent unrolling of the convolutions and to hold the convolutions against the side of the tube opposite said one side of the tube, wherein the loop structure is elongated and has spaced opposite end portions, and wherein the securing step entails securing the end portions of the loop structure to the tube.

2. The method of claim 1, wherein the steps of rolling the tube and of rolling the loop structure extent are performed alternately.

3. The method of claim 1, wherein the step of securing the loop structure to the tube is conducted concurrently with a preliminary step of flattening and sealing the flattened and sealed end of the tube.

4. In combination with a squeeze dispensing tube of the class including an elongated flexible and tubular body having a closable dispensing opening at one end and which is flatted and sealed at its other end, the improvement comprising a loop structure of a resilient and flexible material together with means for securing the loop structure to the flattened and sealed end of the tube in an arrangement such that the loop structure is generally normal to the longitudinal extent of the tube and resiliently embraces one side of the tube adjacent the flattened and sealed end of the tube, said loop structure being elongated and having spaced end portions, with the securing means serving to secure the end portions of the loop structure to the tube.

5. The combination of claim 4, wherein the loop structure is of substantially rectangular transverse section.

6. The combination of claim 4, wherein the loop structure is of substantially circular transverse section.

7. The combination of claim 4, wherein the end portions are secured to the sealed end of the tube.

8. In combination with a squeeze dispensing tube of the class including an elongated flexible and tubular body having a closable dispensing opening at one end and which is flattened and sealed at its other end, the improvement comprising a loop structure of a resilient and flexible material together with means for securing the loop structure to the flattened and sealed end of the tube in the arrangement such that the loop structure is generally normal to the longitudinal extent of the tube and resiliently embraces one side of the tube adjacent and flattened and sealed end of the tube, wherein said loop structure being an elongated endless element, and wherein the securing means comprises a U-shaped clamp.

9. The combination of claim 8, wherein the clamp is resilient and slidably disposed over the flattened and sealed end of the tube and an intermediate extent of the loop structure.

10. In combination with a squeeze dispensing tube of the class including an elongated flexible and tubular body having a closable dispensing opening at one end and which is flattened and sealed at its other end, the improvement comprising a loop structure of a resilient and flexible material together with means for securing the loop structure to the flattened and sealed end of the tube in an arrangement such that the loop structure is generally normal to the longitudinal extent of the tube and resiliently embraces one side of the tube adjacent the flattened and sealed end of the tube, wherein the securing means comprises a bifurcated clip embracing the loop structure, with said clip receiving in sandwich-like fashion and being sealed to said flattened and sealed end of the tube.

* * * * *